US005247128A

United States Patent [19]

Suzuki

[11] Patent Number: 5,247,128

[45] Date of Patent: Sep. 21, 1993

[54] ELECTRONIC MUSICAL INSTRUMENT WITH SELECTABLE RHYTHM PAD EFFECTS

[75] Inventor: Satoshi Suzuki, Hamamatsu, Japan

[73] Assignee: Yamaha Corporation, Hamamatsu, Japan

[21] Appl. No.: 470,918

[22] Filed: Jan. 26, 1990

[30] Foreign Application Priority Data

Jan. 27, 1989 [JP] Japan ..... 1-18553
Mar. 29, 1989 [JP] Japan ..... 1-36112[U]

[51] Int. Cl.[5] ..... G10H 1/40

[52] U.S. Cl. ..... 84/611; 84/635; 84/651; 84/614

[58] Field of Search ..... 84/DIG. 12-24, 84/611, 612, 604-607, 626, 827, 632, 634, 635, 651, 663, 609, 610, 611, 614, 636

[56] References Cited

U.S. PATENT DOCUMENTS 4,194,427 3/1980 Deutsch ..... 84/632
4,479,412 10/1984 Klynas ..... 84/730
4,622,878 11/1986 Sharp ..... 84/DIG. 1
4,757,736 7/1988 Tajima et al. ..... 84/DIG. 12
4,922,797 5/1990 Chapman ..... 84/650
4,991,486 2/1991 Ito et al. ..... 84/611

FOREIGN PATENT DOCUMENTS 59-18471 5/1984 Japan .
1-177090 7/1989 Japan .
2-77097 3/1990 Japan ..... 84/611

*Primary Examiner*—William M. Shoop, Jr.
*Assistant Examiner*—Brian Sircus
*Attorney, Agent, or Firm*—Graham & James

[57] ABSTRACT

An electronic musical instrument provides at least one pad to which a desirable musical tone such as a percussion instrument tone is assigned. When operating the pad, the corresponding musical tone is to be generated. Thereafter, when the pad operation is terminated, the musical tone can be simultaneously muted, decayed gradually or continuously generated for a while in accordance with the performer's control. An effected tone, i.e., a musical tone to which a musical effect is applied, can be also assigned to the pad. In this case, by operating the pad, the assigned effected tone can be generated.

7 Claims, 11 Drawing Sheets

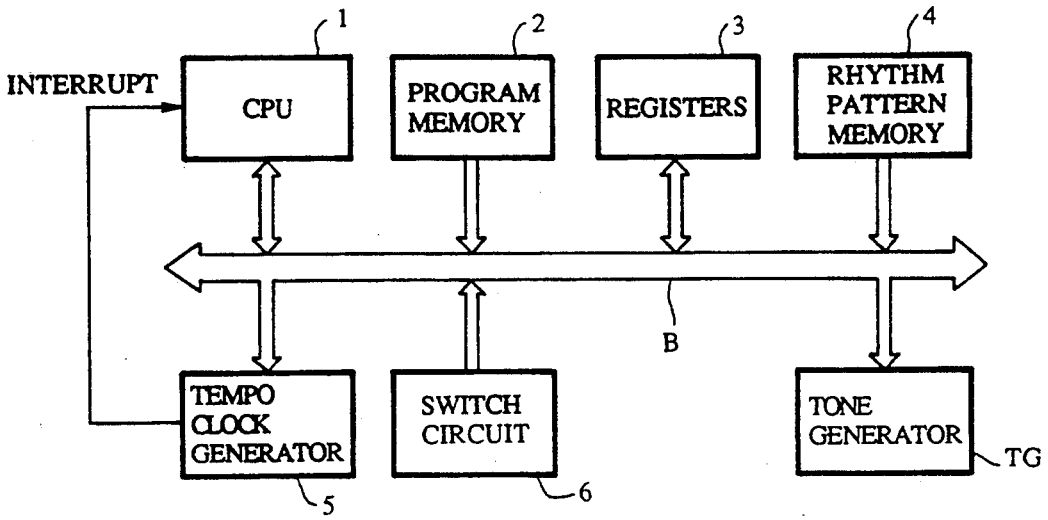
FIG. 1
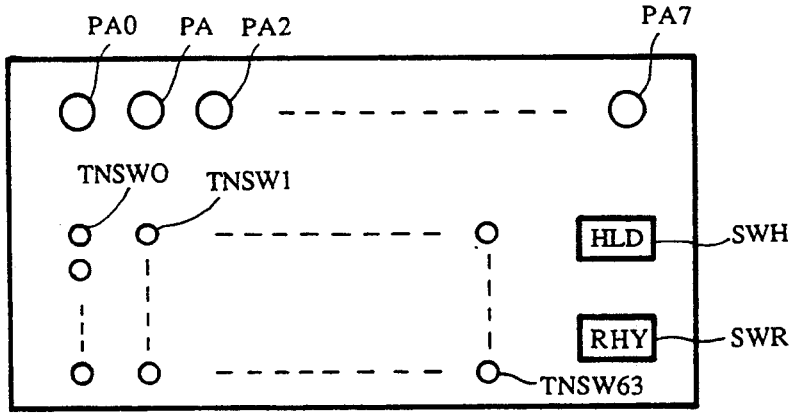
FIG. 2
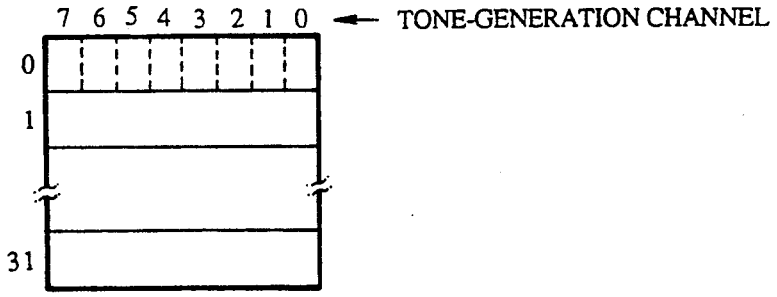
FIG. 3 (CONFIGURATION OF RHYTHM ON-TIMING REGISTER)

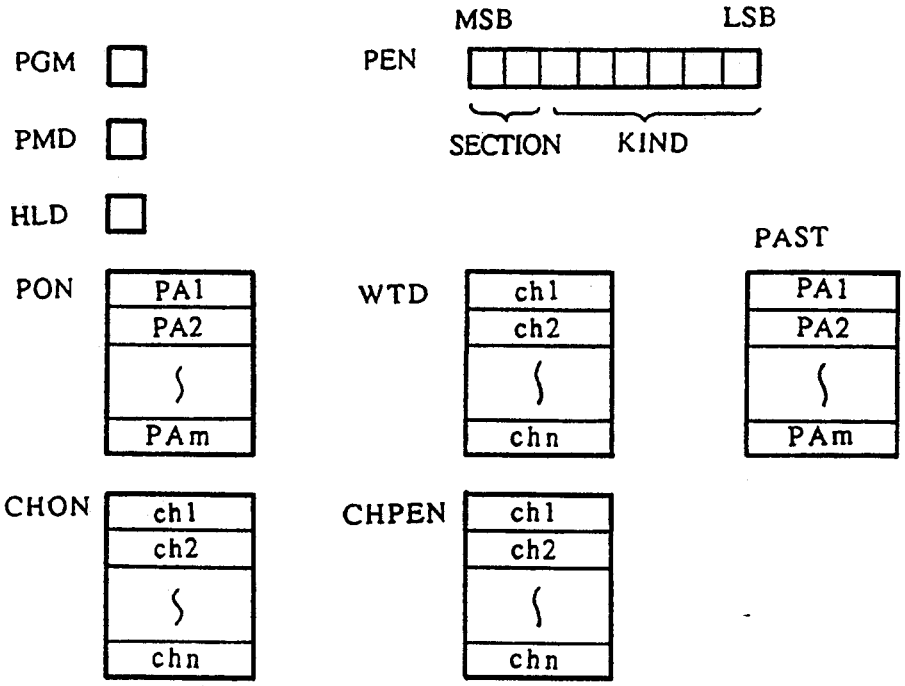
FIG. 7 (CONFIGURATION OF REGISTER & FLAGS IN RAM 20)
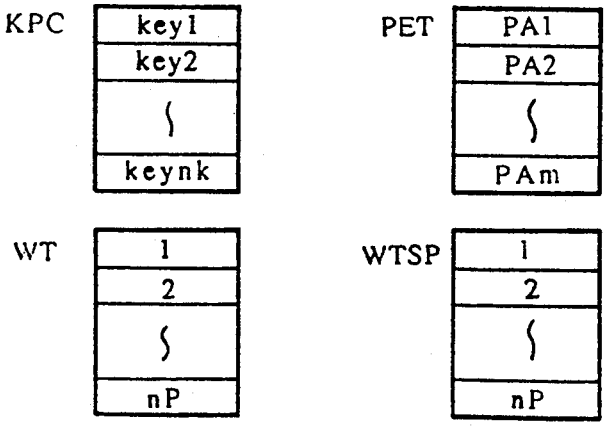
FIG. 8 (CONFIGURATION OF DATA TABLES IN ROM19)

(MAIN ROUTINE)

(PROGRAM MODE SWITCH PROCESS ROUTINE)

(PAD MODE SWITCH PROCESS ROUTINE)

(HOLD MODE SWITCH PROCESS ROUTINE)

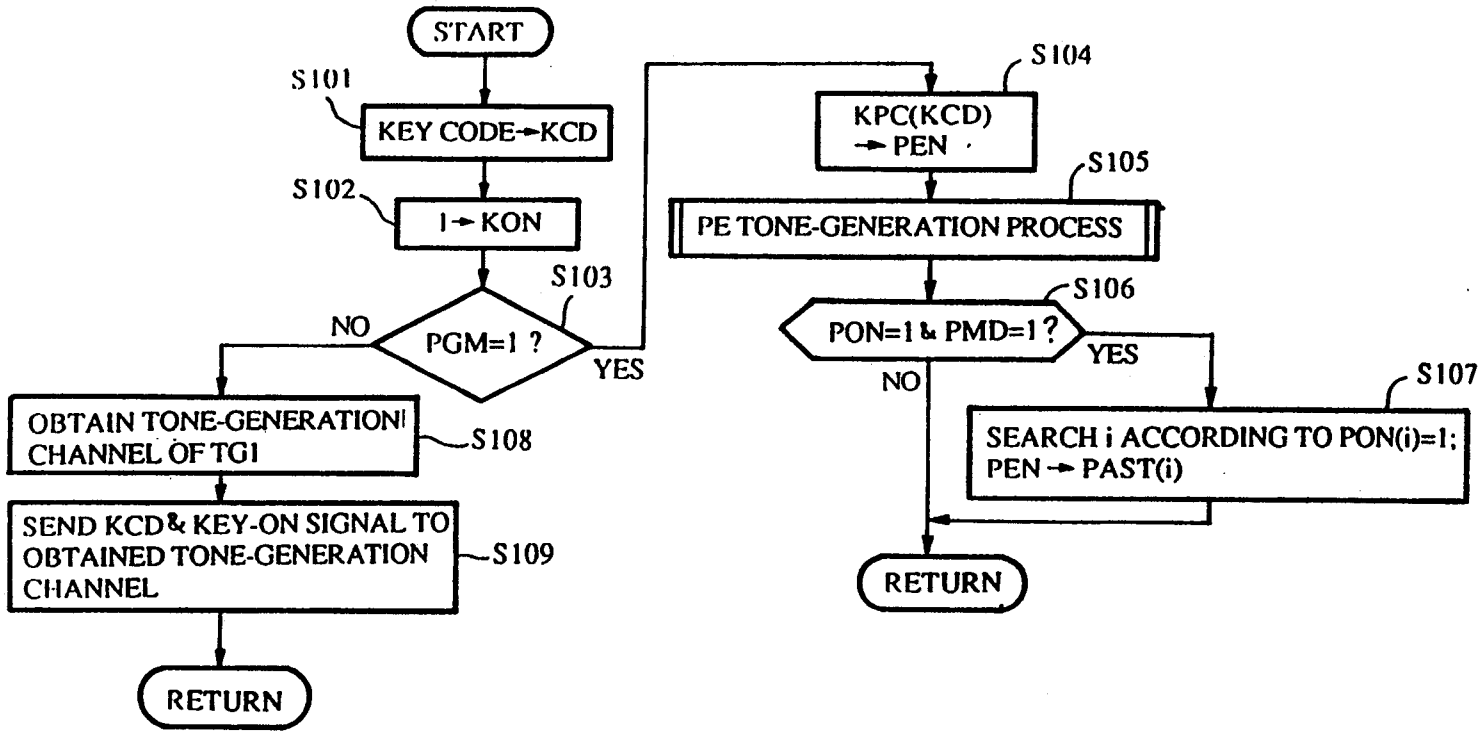
FIG. 10 (KEY-ON PROCESS ROUTINE)

(KEY-OFF PROCESS ROUTINE)

(PAD-ON PROCESS ROUTINE)

(PAD-OFF PROCESS ROUTINE)

(PE TONE-GENERATION ROUTINE)

(WTD(j) SETTING ROUTINE)

(ENVELOPE WAVEFORM)

(TIMER INTERRUPT ROUTINE)

ELECTRONIC MUSICAL INSTRUMENT WITH SELECTABLE RHYTHM PAD EFFECTS

BACKGROUND OF THE INVENTION

1. Field of the Invention

The present invention relates to an electronic musical instrument capable of generating a rhythm tone with a melody tone.

2. Prior Art

Conventionally, several kinds of electronic musical instruments capable of generating a rhythm tone are known. Among them, a first conventional electronic musical instrument capable of carrying out an automatic rhythm performance provides a rhythm tone source for generating rhythm tone signals of rhythm instruments such as a bass drum, snare drum, cymbal etc. and it also provides a rhythm pattern memory for storing rhythm pattern information indicative of rhythm patterns such as waltz, rumba, march etc. Next, a second conventional electronic musical instrument provides rhythm tone designating means called a "pad" in addition to the above-mentioned function of carrying out the automatic rhythm performance. By beating this pad the corresponding rhythm tones are generated. This kind of electronic musical instrument is disclosed in Japanese Utility Model Publication No. 59-18471, for example. As a further example of the foregoing second conventional electronic musical instrument, Japanese Patent Laid-Open Publication No. 1-177090 is known. Herein, kinds of tone of the percussion instruments such as hi-hat cymbal, bass drum and triangle can be programmed to the pads. As described above, the conventional electronic musical instrument can sound the percussion instrument tones by operating the pad. However, it cannot sound a musical tone to which an unconventional musical effect is applied (for example, sounds such as a siren sound, wave sound, drum roll, explosive sounds, etc.; hereinafter, such unconventional tones are simply referred to as "effected tone") by the pad operation. Further, a third conventional electronic musical instrument with a so-called "hold-mode function" can hold musical tone information when musical tones are generated by the operation of the pad or keyboard. Therefore, this third conventional electronic musical instrument can continue to generate the musical ton after the operation of the pad or keyboard is off.

However, in the case where the musical tone to be generated is the attenuating tone (or damping tone), the above-mentioned third conventional electronic musical instrument with the hold-mode function must attenuate its musical tone in accordance with the predetermined envelope waveform. For this reason, there is a problem in that the tone-generation cannot be continued even if the musical tone information is held for an extended period of time.

SUMMARY OF THE INVENTION

It is accordingly a primary object of the present invention to provide an electronic musical instrument which can continue to generate the attenuating tone for an extended period of time after the pad operation is off.

It is another object of the present invention to provide an electronic musical instrument which can sound the desirable effected tone by the pad operation.

In a first aspect of the present invention, there is provided an electronic musical instrument comprising:

(a) manually operable means which is manually operated by a performer in order to carry out a musical performance;

(b) detecting means for detecting an operation effected on the manually operable means;

(c) input means for inputting a hold command from the performer;

(d) tempo clock generating means for generating a tempo clock having a frequency corresponding to a predetermined performance speed;

(e) count means for counting the tempo clock;

(f) means for storing musical tone information corresponding to the operation of the manually operable means and also holding a count value of the count means at a time when the manually operable means is operated during a period when the input means inputs the hold command; and (g) musical tone generating means for generating a musical tone corresponding to the operation of the manually operable means, the musical tone generating means repeatedly generating musical tones corresponding to the musical tone information every time the count value of the count means coincides with that held in the means during the period when the input means inputs the hold command.

In a second aspect of the present invention, there is provided an electronic musical instrument comprising:

(a) at least one key and one pad to be provided as manually operable members;

(b) tone source information storing means for storing tone source information indicative of a kind of an effected tone which is assigned to each key, wherein the effected tone is a tone to which a musical effect is applied;

(c) assigning information storing means for storing assigning information applied to each pad;

(d) pad designating means for designating a desirable pad within a plurality of pads;

(e) means for reading out the tone source information corresponding to an operated key from the tone source information storing means and then writing read tone source information into the assigning information storing means as the assigning information corresponding to the pad designated by the pad designating means; and (f) musical tone signal generating means for reading out the assigning information from the assigning information storing means when a pad operation is detected, so that the musical tone signal generating means generates a musical tone signal corresponding to the effected tone based on the assigning information.

In a third aspect of the present invention, there is provided an electronic musical instrument comprising:

(a) random number generating means for generating a random number corresponding to information concerning a tone-generation timing;

(b) designating means for designating a musical tone generation at the tone-generation timing; and (c) tone source means for generating a musical tone under designation of the designating means.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings:

FIG. 1 is a block diagram showing the electric configuration of an electronic musical instrument according to a first embodiment of the present invention;

FIG. 2 shows a face of an operation panel used in the first embodiment shown in FIG. 1;

FIG. 3 shows a data storage configuration of a rhythm on-timing register used in the first embodiment shown in FIG. 1;

FIG. 7 shows data configuration of registers and flags to be stored in a random-access memory shown in FIG. 6;

FIG. 8 shows data configuration of tables provided in a read-only memory shown in FIG. 6;

FIGS. 9 to 17, 19, 20 are flowcharts which are used for explaining operations of the second embodiment.

DESCRIPTION OF PREFERRED EMBODIMENTS

Figure 4:
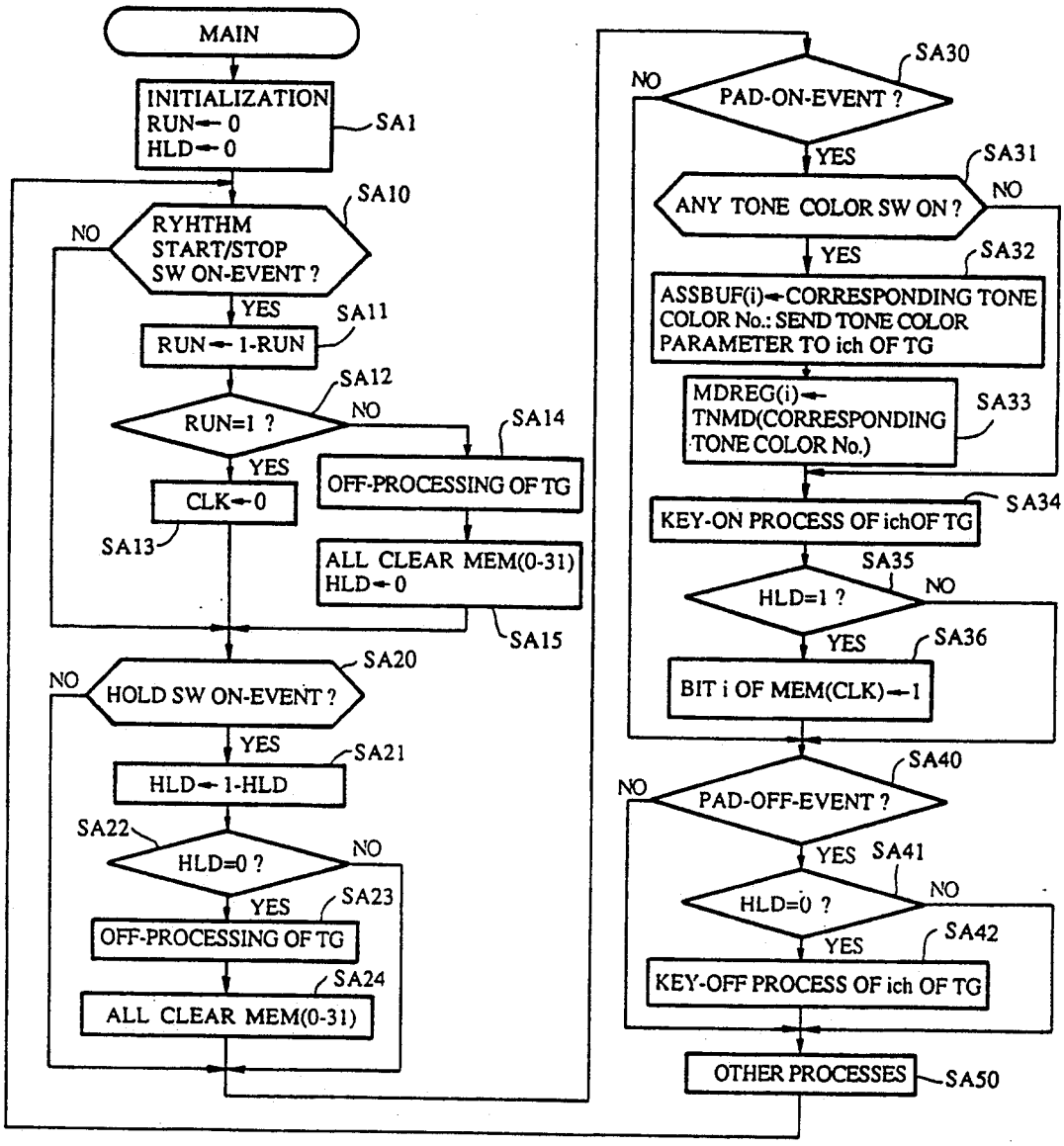
FIG. 4 is a flowchart showing a main routine to be executed by the first embodiment shown in FIG. 1.

Next, description will be given with respect to preferred embodiments of the present invention by referring to the drawings.

[A] FIRST EMBODIMENT

(1) Configuration of First Embodiment

FIG. 1 is a block diagram showing the electric configuration of the electronic musical instrument according to the first embodiment of the present invention. In FIG. 1, 1 designates a central processing unit (CPU) which controls the present electronic musical instrument as a whole, and 2 designates a program memory for storing control programs. In addition, 3 designates registers which are used to temporarily store the control data for the CPU 1. Further, 4 designates a rhythm pattern memory for storing rhythm patterns used for carrying out the automatic rhythm performance, and 5 designates a tempo clock generator which generates and supplies a tempo clock to the CPU 1 as an interrupt request signal by every predetermined time. This tempo clock generator 5 includes an oscillator and a frequency divider (not shown), wherein this frequency divider divides the oscillation frequency the of oscillator. When the performer operates a performance speed control (not shown) provided on an operation panel of the electronic musical instrument body to thereby designate and input the desirable performance speed, the CPU 1 generates data corresponding to the inputted performance speed, which is used as a frequency dividing ratio of the frequency divider within the tempo clock generator 5. Thus, the tempo clock generator 5 can generate the tempo clock having the frequency corresponding to the desirable performance speed.

Next, 6 designates a switch circuit for detecting operating states (i.e., on/off states) of several kinds of manually operable members such as switches and controls provided in the present electronic musical instrument. In the first embodiment, the CPU 1 detects the on/off states of pad (which will be described later) and operating states of other manually operable members, so that the musical tone generation control corresponding to the detected states is carried out under control of the CPU 1. TG designates a tone generator which forms a musical tone signal, which is to be supplied to a sound system (not shown). Therefore, the sound system will generate the musical tone corresponding to the musical tone signal. The above-mentioned portions such as CPU 1, program memory 2, registers 3, rhythm pattern memory 4, tempo clock generator 5, switch circuit 6 and tone generator TG are all connected to each other by a bus B.

FIG. 2 illustrates an example of an operation panel used in the present electronic musical instrument. In FIG. 2, PA0-PA7 designate pads. By beating these pads, the rhythm tones are generated. Herein, the rhythm tone generation according to the pad operation will be described later. In addition, TNSW0-TNSW63 designate tone color switches. When any one of these tone color switches TNSW0-TNSW63 is operated on, the tone color corresponding to the operated tone color switch is set as the tone color used in the present electronic musical instrument. SWH designates a hold mode switch for setting and releasing a hold mode, and SWR designates a rhythm start/stop switch for setting and releasing an automatic rhythm mode.

Next, description will be given with respect to some of the registers and flags contained in the registers 3 shown in FIG. 1 and several control data stored in a read-only memory (ROM, not shown) as follows.

(a) Rhythm On-Timing Register MEM(n) (where n=0-31):

In the first embodiment, one bar is divided into thirty-two sections, whereby the musical tone generation control is carried out on each section. The rhythm on-timing register MEM(n) stores the tone-generation timing of the rhythm tone at the hold mode, which is configured as shown in FIG. 3. More specifically, when No.i pad is operated on in No.j section of the bar at the hold mode, "1" is set at bit i of MEM(j) (where i, j are integral numbers).

(b) Tone Color Mode Table TNMOD(k) (where k=0-63):

The first embodiment can generate sixty-four kinds of sounds including continuing tones such as the sound of a wave, siren sound of a patrol car, and drum-roll sounds; explosive tones such as a gunshot; and attenuating tones such as bass-drum sounds. By use of the above-mentioned tone color switches TNSW0-TNSW63, the tone to be generated is designated. The tone color mode register TNMOD(k) is the table stored in the ROM (not shown). Each data stored in this table designates the kind of the ton color of each of the tone color switches. For example, each data indicates that the tone color corresponding to the tone color switch is generated as the continuing tone or attenuating tone. Such data is set as TNMOD(K)="0" when the continuing tone corresponds to the tone color switch TNSW k, while it is set as TNMOD(K)="1" when the attenuating tone corresponds to the tone color switch TNSW k.

(c) Tone Color Register ASSBUF(i) (where i=0-7):

The tone generator TG shown in FIG. 1 provides eight channels. The tone color register ASSBUF(i) stores the tone color number (i.e., any one of numbers 0-63) of the tone to be generated from No.i channel in TG.

(d) Mode Register MDREG(i) (where i=0-7):

The mode register MDREG(i) stores the data indicating the continuing tone or attenuating tone to be assigned to each channel of the tone generator TG. When the continuing tone is assigned to No.i channel, MDREG(i)="0". On the other hand, when the attenuating tone is assigned to No.i channel, MDREG(i)="1".

(e) Tempo Clock Count Register CLK:

The tempo clock count register CLK stores the count value of the tempo clock generated from the tempo clock generator 5. This register CLK is constructed as 5-bit register, whose value ranges from "0" to "31". Therefore, when the count value is further incremented from "31", the next count value is returned at "0".

(f) Hold Flag HLD:

In the case where the hold flag HLD is at "0", the rhythm tone is generated only when the pad is beaten. When the hold flag is at "1", the present electronic musical instrument is subject to the hold mode, wherein the rhythm tone is continuously generated for an extended period of time after the pad is beaten. The value of this hold flag HLD is inverted between "0" and "1" every time the hold switch SWH is pushed.

(g) Rhythm Start/Stop Flag RUN:

By setting the rhythm start/stop flag RUN at "1", the present electronic musical instrument is subject to the automatic rhythm mode. The value of this flag RUN is inverted between "0" and "1" every time the rhythm start/stop switch SWR is pushed.

(2) Operation of First Embodiment

Next, description will be given with respect to the operation of the first embodiment. At first, when the power is on, the CPU 1 starts to execute the main routine indicated by the flowchart shown in FIG. 4. In a first step SA1, the CPU 1 carries out the initialization process such that the registers 3 are all initialized. Herein, both of the rhythm start/stop flag RUN and hold flag HLD are set at "0".

In next step SA10, it is judged whether or not the switch circuit 6 detects the on-event of the rhythm start/stop switch SWR. If the judgement is "NO", the processing proceeds to step SA20 wherein it is judged whether or not the switch circuit 6 detects the on-event of the hold switch SWH. Then, if the judgement of step SA20 is "NO", the processing proceeds to step SA30 wherein it is judged whether or not the on-event is detected on any one of the pads PA0–PA7. If the judgement of step SA30 is "NO", the processing proceeds to step SA40 wherein it is judged whether or not the off-event is detected on any one of the pads PA0–PA7. If the judgement of step SA40 is "NO", the processing proceeds to step SA50 wherein other processes are made. More specifically, in step SA50, it is judged whether or not the on/off-event has occurred on other manually operable members such as a rhythm select switch, a tone volume control etc. Then, based on the judgement results, the musical tone generation control is carried out. Thereafter, the processing returns to the foregoing step SA10. As described above, the present electronic musical instrument detects the operating states of the switches and controls to thereby carry out the desirable musical tone generation control.

Next, detailed description will be given with respect to each of several process executed by the first embodiment.

(a) Processing to be executed in response to the operation of the rhythm start/stop switch SWR:

When the rhythm start/stop switch SWR is pushed by the performer, the judgement of step SA10 turns to "YES" so that the processing proceeds to step SA11 wherein the rhythm start/stop flag RUN is inverted by carrying out operation "1-RUN".

Just after the power is on, this flag RUN is at "0". Thus, due to the inversion of step SA11, the flag RUN is set at "1" indicating the automatic rhythm mode. In step SA12, it is judged whether or not the flag RUN is at "1". In this case, the judgement of step SA12 is "YES", so that the processing proceeds to step SA13 wherein the value of the tempo clock count register CLK is cleared at "0". Then, the processing proceeds to the foregoing step SA20.

Next, when the rhythm start/stop switch SWR is pushed by the performer while RUN="1", the flag RUN is inverted to "0" in step SA11. Therefore, the judgement of step SA12 turns to "NO" so that the processing branches to step SA14 wherein the off-process is carried out on the TG. More specifically, the CPU 1 detects the tone-generation state of the tone generator TG, and then the CPU 1 turns off all tone-generating channels except the channels which generate the tones corresponding to the pad operations. Then, the processing proceeds to step SA15 wherein all of the rhythm on-timing registers MEM(n) are cleared at "0", and the hold flag HLD is also cleared at "0". In other words, when the automatic rhythm mode is released, the hold mode is to be automatically released in the first embodiment. After completing the process of step SA15, the processing proceeds to step SA20.

(b) Processing to be executed in response to the operation of the hold switch SWH:

When the hold switch SWH is pushed, the judgement of step SA20 turns to "YES" so that the hold flag HLD is inverted in step SA21. In next step SA22, it is judged whether or not the hold flag HLD is at "0". If the judgement of step SA22 is "NO", the processing directly branches to step SA30. On the other hand, if the judgement of step SA22 is "YES", the processing proceeds to step SA23 wherein the CPU turns off all channels except the channels which generate the tones corresponding to the pad operations and the channels which generate the automatic rhythm tones. Then, the processing proceeds to step SA24 wherein all of the rhythm on-timing registers MEM(n) are cleared at "0". Thereafter, the processing proceeds to step SA30. As described above, when the hold switch SWH is pushed, the hold flag HLD is inverted. If the hold flag HLD is reset at "0" due to such inversion, the muting process is carried out on the tone generator TG and the values of the rhythm on-timing registers MEM(n) are all cleared.

Figure 5:
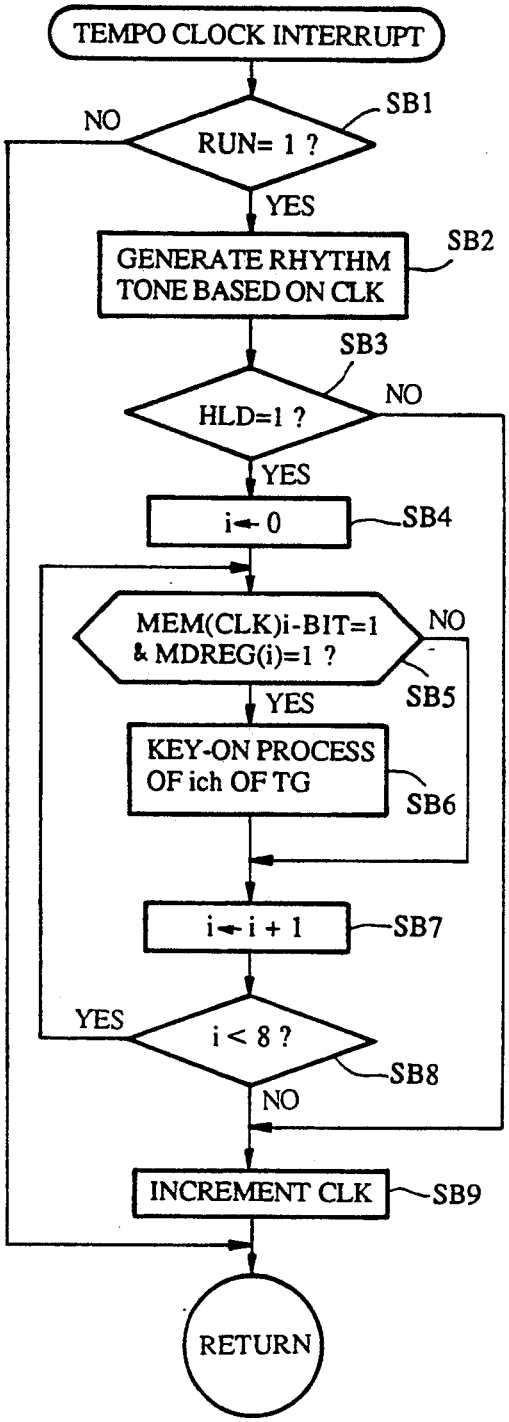
FIG. 5 is a flowchart showing a tempo clock interrupt routine.

(c) Processing to be executed in the automatic rhythm mode:

In FIG. 1, when the tempo clock generated from the tempo clock generator 5 is supplied to the CPU 1 as the interrupt signal, the CPU 1 starts to execute a tempo clock interrupt routine as shown in FIG. 5. First, in step SB1, it is judged whether or not the rhythm start/stop flag RUN is at "1", in other words, it is judged whether or not the automatic rhythm mode is set. If the judgement of step SB1 is "YES", the processing proceeds to step SB2. In step SB2, the address corresponding to the value of the tempo clock count register CLK is fed to the rhythm pattern memory 4, from which the corresponding rhythm pattern is read out. The read rhythm pattern is sent to the tone-generation channel of the tone generator TG, so that the automatic rhythm tone is to be generated. Then, the processing proceeds to step SB3 wherein it is judged whether or not the hold flag HLD is at "1", in other words, it is judged whether or not the hold mode is set. If the judgement of step SB3 is "NO", the processing directly branches to step SB9 wherein the value of the tempo clock count register CLK is incremented. Thereafter, the processing returns back to the main routine shown in FIG. 4. This describes that the hold mode is not set. Incidentally, description of the hold mode will be given later. As described above, in the automatic rhythm mode, the rhythm pattern corresponding to the value of the tempo clock count register CLK is read from the rhythm pattern memory 4 every time the tempo clock is generated. Then, the tone generator TG will generate the automatic rhythm tone, and the register CLK is subject to increment. In contrast, when the rhythm start/stop flag RUN is at "0", the judgement of step SB1 is "NO" so that the processing directly returns back to the main routine shown in FIG. 4 without executing any processes.

(d) Processing to be executed in response to the pad operation:

When the performer beats any one of the pads PA0--PA7 so that the switch circuit 6 detects the pad on-event, the judgement of step SA30 shown in FIG. 4 turns to "YES". Therefore, the processing proceeds to step SA31 wherein it is judged whether or not any one of the tone color switches TNSW0-TNSW63 is on. If the judgement of step SA31 is "YES", the processing proceeds to next step SA32. If the number of the pad which is turned on is designated by "i", the tone color number k corresponding to the tone color switch which is turned on is set to the tone color register ASSBUF(i). In addition, its tone color parameter is sent to No.i channel of the tone generator TG. Then, the processing proceeds to step SA33 wherein the value of the tone color mode table TNMOD(k) corresponding to the tone color number k which is set in foregoing step SA32 is set to the mode register MODREG(i) corresponding to the pad number i.

Thereafter, the processing proceeds to step SA34 wherein the key-on signal is supplied to No.i channel of the tone generator TG. Thus, No.i channel generates the rhythm tone having the tone color corresponding to the tone color number k. Meanwhile, if the judgement of the foregoing step SA31 is "NO", the process of step SA32 is not executed, the result being that No.i channel generates the rhythm tone in the tone color corresponding to the tone color parameter which was previously set thereto. Next, the processing proceeds to step SA35 wherein it is judged whether or not the hold flag HLD is at "1", in other words, it is judged whether or not the hold mode is set. If the judgement of step SA35 is "NO", the processing directly branches to step SA40. On the other hand, if the judgement of step SA35 is "YES", the processing proceeds to step SA36 wherein "1" is set at bit i of the register MEM(CLK) corresponding to the count value of the tempo clock count register CLK. As described above, when any one of the pads PA0-PA7 is operated n in the hold mode, the timing when the pad is operated on is stored.

Next, when the pad off-event is detected, the judgement of step SA40 turns to "YES" so that the processing proceeds to step SA41 wherein it is judged whether or not the hold flag HLD is at "0". If the judgement of step SA41 is "YES", i.e., if the hold mode is not set, the CPU 1 releases the key-on signal supplied to No.i channel of the tone generator TG (where i designates the number of the pad which is off) so that the tone generated from No.i channel is muted. Then, the processing proceeds to step SA50. On the other hand, if the judgement of step SA41 is "NO", i.e., if the hold mode is set, the processing directly branches from step SA41 to step SA50 without executing the process of step SA42. In other words, after No.i channel generates the rhythm tone when the pad PAi is on, the key-on signal supplied to No.i channel is not released in the hold mode eve when the pad PAi is off. In the case where the continuing tone is assigned to No.i channel (i.e., MDREG(i)="0"), generation of such continuing tone is continued thereafter. In contrast, in the case where the attenuating tone is assigned to No.i channel (i.e., MDREG(i)="1"), such attenuating tone generated from No.i channel is attenuated in accordance with the predetermined envelope.

(e) Processing to be executed when both of the automatic rhythm mode and hold mode are set:

In this case, when the tempo clock interrupt routine as shown in FIG. 5 is activated due to the tempo clock interrupt, the processing passes through step SB1 and then the process of step SB2 is executed, so that the automatic rhythm tone is generated. Then, the judgement of step SB3 turns to "YES", so that the processing proceeds to next step SB4 wherein the tone-generation channel number i is initialized to "0".

In next step SB5, it is judged whether or not bit i of the rhythm on-timing register MEM(CLK) is at "1" and the value of the mode register MDREG(i) is at "1", wherein MEM(CLK) corresponds to the count value of the tempo clock count register CLK as described before. If any one of the pads PA0-PA7 is not on at all until now after the hold mode is set, the judgement of step SB5 turns to "NO" so that the processing directly branches to step SB7 wherein the tone-generation channel number i is incremented. In step SB8, it is judged whether or not the tone-generation channel number i is smaller than "8". If the judgement of step SB8 is "YES", the processing returns to step SB5. Thus, the above-mentioned processes of steps SB5-SB8 are repeatedly executed with respect to each of the tone-generation channel numbers i which range from "1" to "7". Thereafter, when the tone-generation channel number i reaches "8" due to the increment of step SB7, the judgement of step SB8 turns to "NO" so that the processing proceeds to step SB9 wherein the value of the tempo clock count register CLK is incremented. Then, the processing returns back to the main routine shown in FIG. 4.

Now, description will be given with respect to the case where the pad PAp is on while the tempo clock count register CLK has the count value kp. At this time, if the tone color switch TNSWq is on, the tone color number q corresponding to the tone color switch TNSWq is set to the tone color register ASSBUF(p) (where p designates the number of the pad which is on) in the main routine shown in FIG. 4. In addition, the tone color parameter corresponding to the tone color switch TNSWq is supplied to No.p channel in step SA32, and the contents of the tone color mode table TNMOD(q) is set in the mode register MDREG(p). Herein, the attenuating tone corresponds to the tone color number q, and "1" is set in the mode register MDREG(p) in step SA33. In this case, as described before, No.p channel executes the tone-generation process in step SA34, and "1" is set at bit p of the rhythm on-timing register MEM(kp).

Under the above-mentioned state, the tempo clock interrupt routine as shown in FIG. 5 is repeatedly activated due to the tempo clock interrupt. Then, when the tempo clock interrupt is made under the state where the count value of the tempo clock count register CLK is incremented to kq, the processing passes through steps SB1-SB4 to thereby reach at step SB5. In this case, during the period while the tone-generation channel number i differs from the number p, the processes of steps SB5-SB7 are repeatedly executed.

However, when the tone-generation channel number i becomes equal to p (i.e., when i=p), "1" is set at bit i (i.e., bit p) of the rhythm on-timing register MEM(CLK) [=MEM(kp)] and "1" is also set in the mode register MDREG(i) [=MDREG(p)]. Therefore, the judgement of step SB5 turns to "YES", so that the processing proceeds to step SB6 wherein the key-on signal is sent to No.i channel of the tone generator TG. Thus, the attenuating ton assigned to this No.i channel is subject to the attack state. Thereafter, as described before, the processes of steps SB7 etc. will be executed. When the tempo clock interrupt routine as shown in FIG. 5 is completed, the processing returns back the main routine as shown in FIG. 4 again. Thereafter, every time the count value of the tempo clock count register CLK reaches kp due to the tempo clock interrupt, the above-mentioned processes are carried out such that the tone-generation process is carried out on the tone-generation channel number p.

In the case where the pad PAp is operated on twice in one bar period when the tempo clock count value is at kp and kw, the attenuating tone is subject to the attack state twice in one bar period. Further, in the case where another pad PAx is operated on, No.x tone-generation channel corresponding to PAx generates the rhythm tone as similar to the case where the pad PAp is operated on as described before. If the generated rhythm tone is the attenuating tone, the attenuating tone is repeatedly subject to the attack state every time its bar is repeatedly performed. Such operations can be understood easier than the foregoing operations concerning the routine shown in FIG. 5.

Next, description will be given with respect to the case where the tone color switch to be operated on corresponds to the continuing tone and "0" is set in the mode register MDREG(p) in step SA33 shown in FIG. 4 when the pad PAp is operated. In this case, even if CLK=kp and i=p in the routine shown in FIG. 5, the judgement of step SB5 turns to "NO" so that the process of step SB6 is omitted. In other words, in case of the continuing tone, re-attack operation is not made due to the tempo clock interrupt even in the hold mode.

Herein, the operation of the first embodiment is described with respect to the case where the attenuating tone generated by the pad operation is continuously sounded. However, it is possible to generate the attenuating tone by the keyboard operation, for example. In this case, every time the bar is repeated, the attenuating tone is subject to the attack state. In addition, the first embodiment determines the tone color which is continuously subject to the attack state in the hold mode. Instead, it is possible to configure a part or all of the tone color mode tables TNMOD(0)-TNMOD(63) by the RAM, wherein it is possible to freely designate the tone color which is continuously subject to the attack state. Further, the first embodiment designates all channels of the tone generator TG to be subject to the hold mode. Instead, it is possible to select a specific tone-generation channel whose tone is only continuously generated in the hold mode.

[B] SECOND EMBODIMENT

Next, description will be given with respect to the second embodiment of the present invention, wherein each pad is selectively used to generate any one of the percussion instrument tones previously set in the factory, assigned percussion instrument tones and assigned effected tones.

(1) Configuration of Second Embodiment

Figure 6:
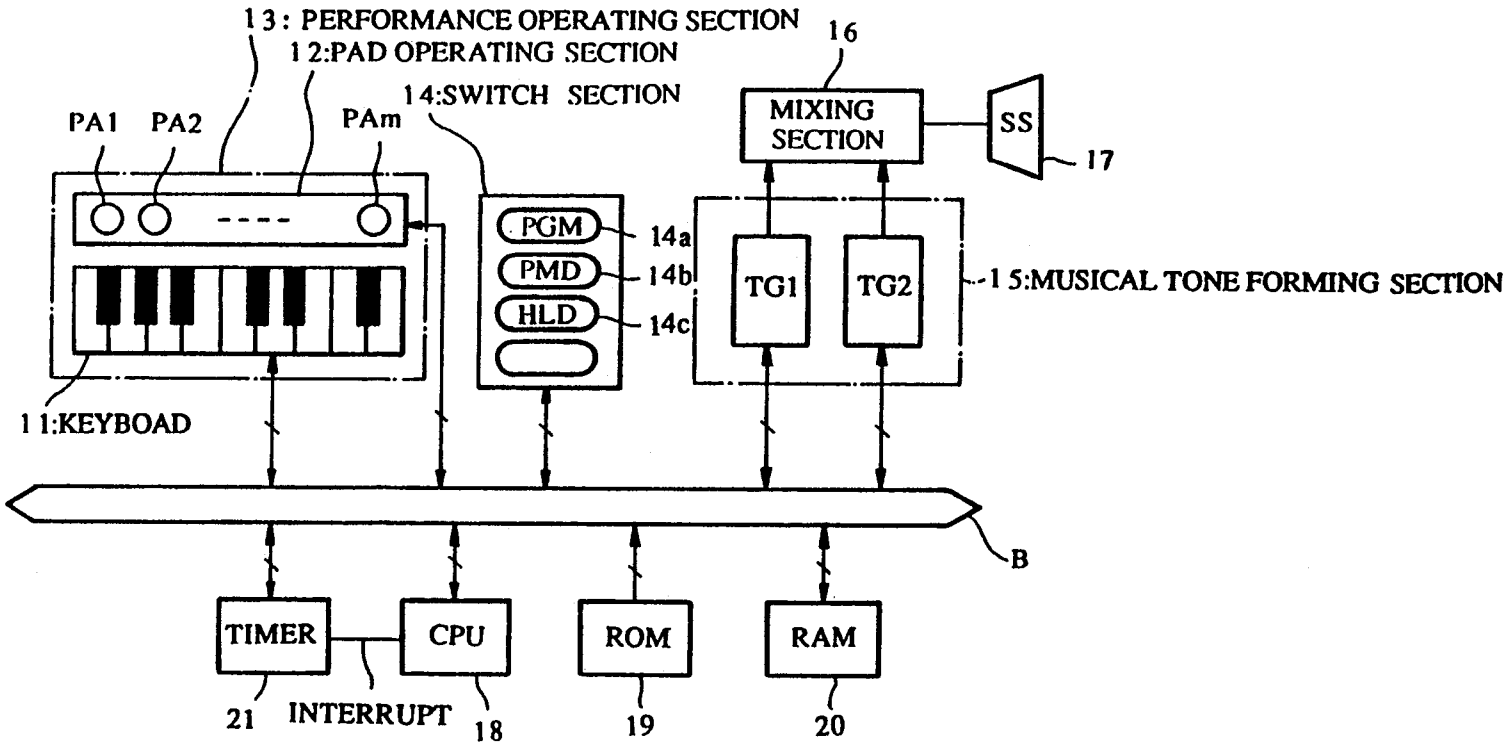
FIG. 6 is a block diagram showing an electric configuration of an electronic musical instrument according to a second embodiment of the present invention.

FIG. 6 is a block diagram showing the configuration of the electronic musical instrument according to the second embodiment of the present invention. In FIG. 6, 11 designates a keyboard providing plural keys, and 12 designates a pad operating section providing plural pads PA1-PAm. Also, 13 designates a performance operating section including the keyboard 11 and pad operating section 12. In addition, 14 designates a switch section providing a program mode switch 14*a*, pad mode switch 14*b*, a hold mode switch 14*c* and other switches. Further, 15 designates a musical tone forming section including a first tone generator TG1 and a second tone generator TG2. Herein, the tone generator TG1 forms the musical tone signal representative of the melody tone, while another tone generator TG2 forms the musical tone representative of the percussion instrument tone and effected tone. Such two kinds of musical tones formed in the musical tone forming section 5 are mixed by a mixing section 16. Then, the mixed musical tone signal is supplied to a sound system 17, from which the corresponding musical tone is sounded. Next, 18 designates a CPU which controls all portions of the electronic musical instrument according to the second embodiment. In addition, 19 designates a ROM for storing control programs and several data tables, and 20 designates a RAM in which temporary storing areas, several registers and flags are set. Further, 21 designates a timer, which outputs an interrupt signal to the CPU 18 when measuring the set time. The above-mentioned performance operating section 13, switch section 14, musical tone forming section 15, CPU 18, ROM 19, RAM 20 and timer 21 are all connected together by bus B.

Next, description will be given with respect to the registers and flags set in the RAM 20 and the data tables set in the ROM 19. Herein, the representative registers, flags and data tables are shown in FIGS. 7 and 8 respectively.

REGISTERS & FLAGS IN RAM 20

(a) Program Mode Flag PGM:

The value set in the program mode flag PGM is inverted every time the program mode switch 14*a* is pushed. The relation between each value of the program mode flag PGM and each mode is as follows:

PGM="0": Normal Performance Mode

PGM="1": Program Mode (b) Pad Mode Flag PMD:

The value of the pad mode flag PMD is inverted every time the pad mode switch 14*b* is pushed. The relation between PMD and each mode is as follows:

PMD="0": When the pad within the pads PA1--PAm is on, the percussion instrument tone or effected tone is generated in accordance with the contents of the corresponding pad tone source table PET(i) (where i ranges from "1" to "m"), which will be described later.

PMD="1": When the pad within the pads PA1--PAm is on, the percussion instrument tone or effected tone is generated in accordance with the contents of the corresponding pad assigning table PAST(i) (where i ranges from "1" to "m"), which will be described later.

(c) Hold Mode Flag HLD:

The value of the hold mode flag HLD is inverted every time the hold mode switch 14c is pushed. Based on the value of this hold mode flag HLD, the tone-generation control is carried out on the percussion instrument tone and/or effected tone as follows.

HLD="0": At this time, the upper two bits of PEN information (which will be described later) are made invalid. As similar to the percussion instrument tone, the musical tone signal of the effected ton after the attack portion is formed such that the effected tone is attenuated in accordance with the predetermined curve.

HLD="1": At this time, the upper two bits of PEN information are made valid.

(d) Tone Source Designating Register PEN:

This register PEN is constructed by an 8-bit register which stores the PEN information (i.e., percussion effect number information). The desirable sound group is designated in response to the upper two bits of the PEN information which equal to "00", "01", "10" or "11" as described below.

"00": percussion instrument tone.

(Example) percussion instrument tone of hi-hat cymbal, bass drum, triangle or the like.

"01": effected tone having continuity.

(Example) sound of wave, braking sound, explosive sound.

"10": effected tone whose attack portion is repeated by a predetermined time interval.

(Example) train sound, church bell sound, gunshot.

"11": effected tone whose attack portion is repeated by a random time interval.

(Example) thunder sound, bird chirping, sound of wind, sound of river stream.

In addition, the lower six bits of the PEN information designate the specific sound kind within the sound group designated by the upper two bits thereof.

(e) Pad-On Flag PON(i) (where i ranges from "1" to "m"):

This pad-on flag PON(i) indicates whether or not the pad PAi is in the on-state. If the pad PAi is on, its pad-on flag PON(i) is set at "1".

(f) Channel-On Flag CHON(j) (where j ranges from "1" to "n"):

This flag CHON(j) indicates whether or not No.j channel of the tone generator TG2 is now used. If No.j channel is used, its channel-on flag CHON(j) is set at "1".

(g) Channel Table CHPEN(j) (where j ranges from "1" to "n"):

This table CHPEN(j) indicates the tone source kind used in No.j channel of the tone generator TG2. Herein, the foregoing PEN information is stored in the channel table CHPEN(j).

(h) Pad Assigning Table PAST(i) (where i ranges from "1" to "m"):

This table PAST(i) indicates the tone source kind corresponding to the pad PAi. Herein, the PEN information is stored in the pad assigning table PAST(i).

(i) Channel Wait Time Table WTD(j) (where j ranges from "1" to "n"):

This table stores the wait time between a first attack timing and a second attack timing with respect to each channel in the case where the effected tone whose attack portion is repeatedly generated. In the case where No.j channel of the tone generator TG2 generates such effected tone whose attack portion is repeated, its wait time is stored in the channel wait time table WTD(j).

TABLES IN ROM 19

(a) Tone Source Kind Table KPC(k) (where k ranges from "1" to "nk"):

In the electronic musical instrument according to the second embodiment, either the percussion instrument one or effected tone is assigned to each key of the keyboard 11. This tone source kind table KPC(k) stores the PEN information indicative of the tone source kind assigned to each key.

(b) Pad Tone Source Table PET(i) (where i ranges from "1" to "m"):

This pad tone source table PET(i) stores the PEN information designating the tone source kind of the percussion instrument tone or effected tone with respect to each of the pads PA1-PAm, wherein this PEN information has been set in advance in the factory.

(c) Wait Time Table WT(n) (where n ranges from "1" to "np"):

This wait time table WT(n) stores the information for designating the time interval by which the attack portion of the effected tone is repeated in relation to the PEN information.

(d) Scaling Table WTSP(n) (where n ranges from "1" to "np"):

This table stores a scaling parameter corresponding to each element of the wait time table WT(n). In order to generate the effected tone whose attack interval is random, the random number is required to be generated. Then, the random number is multiplied by the scaling parameter and further added with the contents of the wait time table WT(n), by which the wait time until the next attack timing can be calculated.

(2) Operation of Second Embodiment

Figure 9:
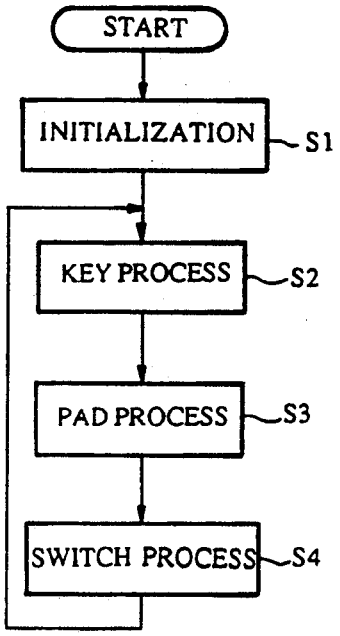

Next, description will be given with respect to the operation of the second embodiment. Herein, the CPU 18 executes the main routine as shown in FIG. 9. When the power is on, the CPU 18 executes the initialization to thereby clear the registers and flags in the RAM 20 in step S1. Thereafter, the CPU 18 repeatedly executes key process (in step S2), pad process (in step S3) and switch process (in step S4).

Figure 11:
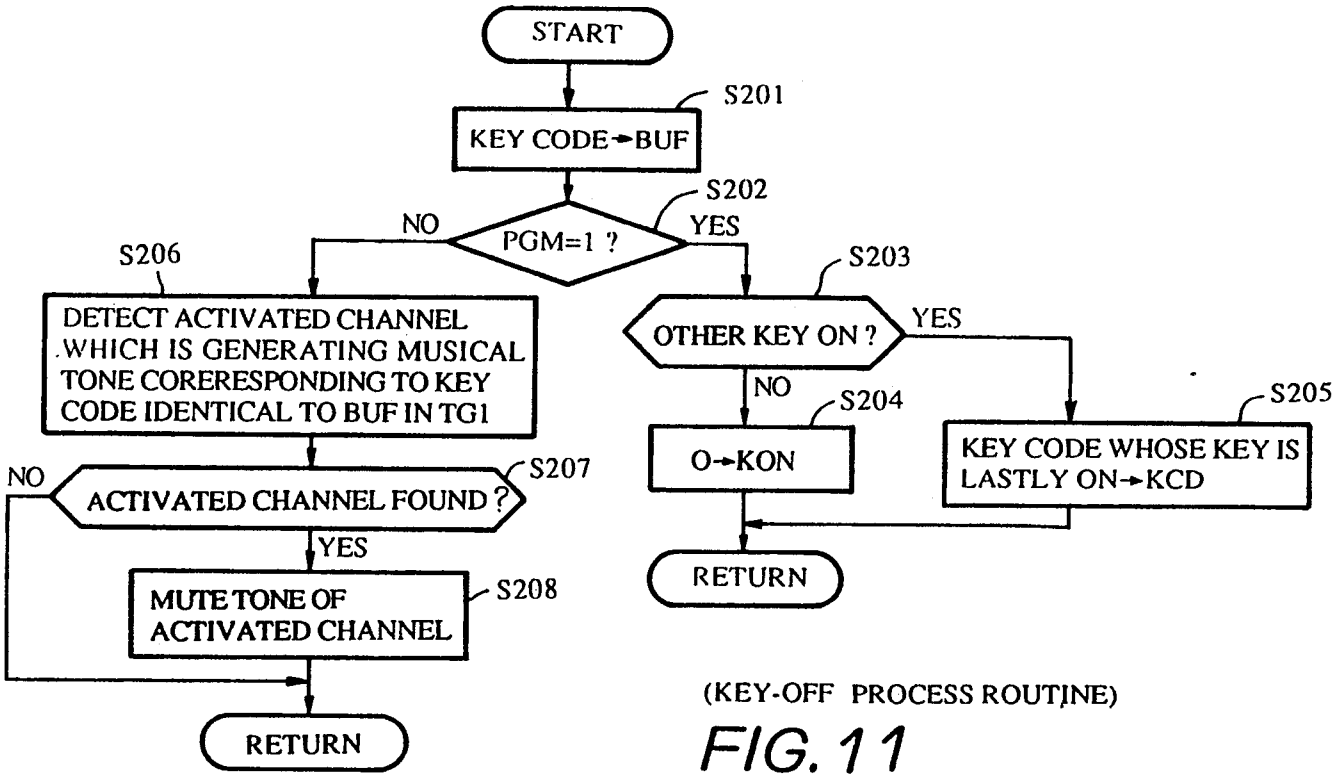
Figure 12:
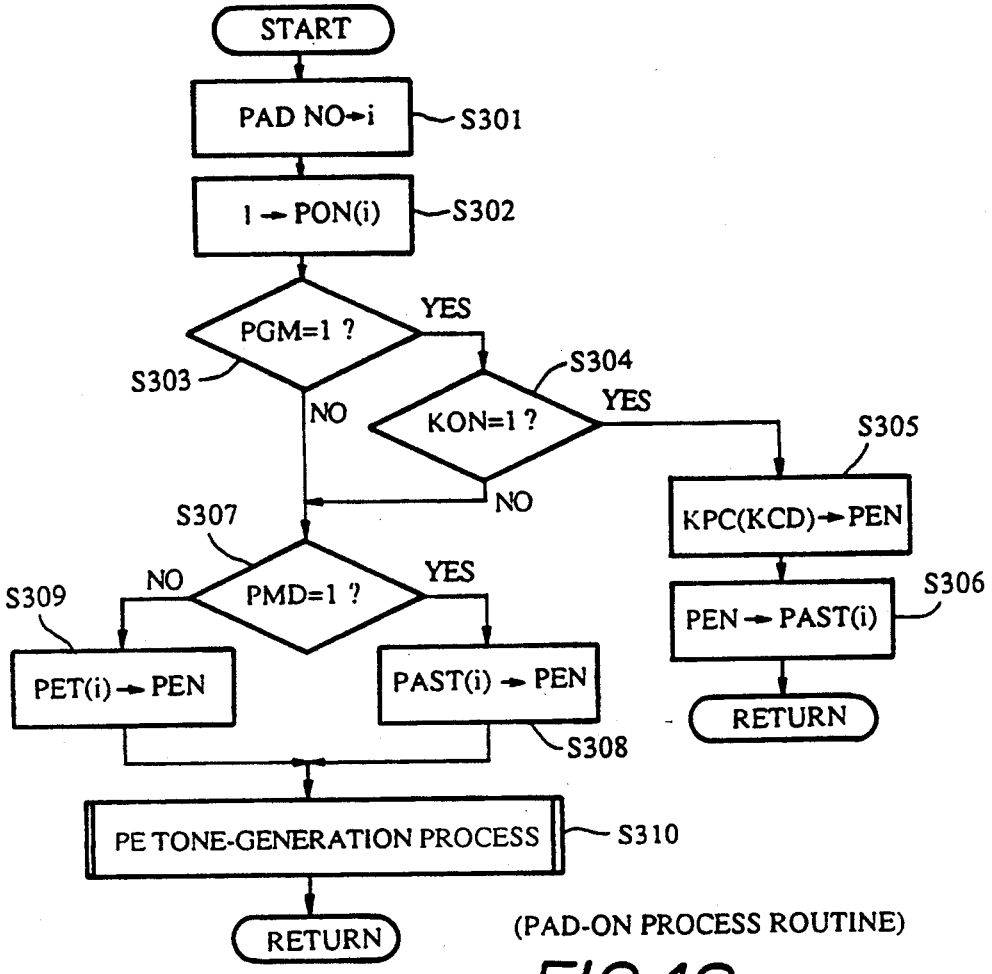
Figure 13:
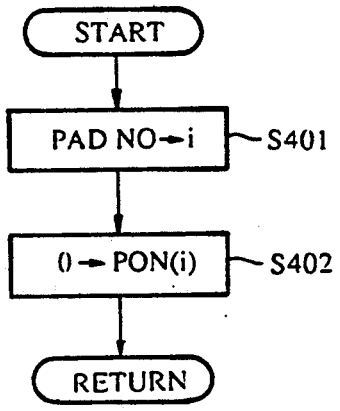

In the case where the performer operates the keyboard 11 so that the key-on event is detected, the CPU 18 executes the key process in step S2 wherein the key-on process routine as shown in FIG. 10 is activated. In contrast, when the key-off event is detected, the key-off process routine as shown in FIG. 11 is activated. If any pad is operated, the CPU 18 executes the pad process of step S3 wherein the pad-on process routine as shown in FIG. 12 or pad-off process routine as shown in FIG. 13 is activated. In addition, when any switch in the switch section 14 is pushed, the process routine corresponding to the pushed switch is to be activated and then executed.

(a) Process Routine Corresponding To Switch Operation

Next, description will be given with respect to the process routine to be executed in response to the operation of each switch in the switch section 14.

Figure 14:
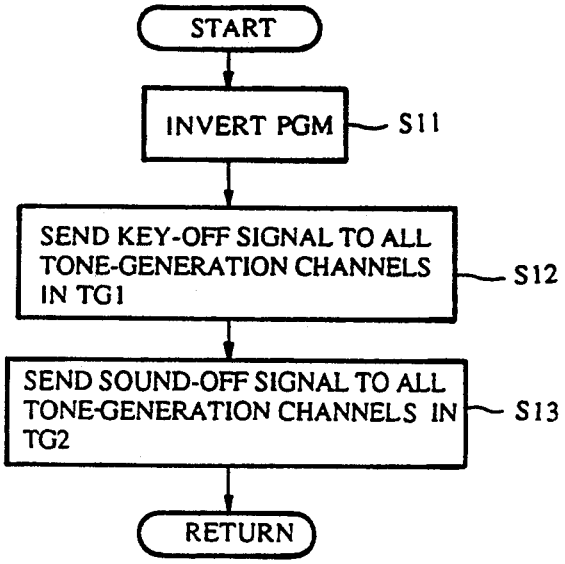

(i) Program mode switch 14*a*:

When the program mode switch 14*a* is pushed, the program mode switch process routine as shown in FIG. 14 is activated. In first step S11, the CPU 18 inverts the value of the program mode flag PGM set in the RAM 20. In next step S12, the CPU 18 supplies key-off signals to all channels of the tone generator TG1. As a result, generation of the melody tone is terminated. In step S13, the CPU 18 supplies sound-off signals to all channels of the tone generator TG2. As a result, generation of the percussion instrument tone and effected tone are terminated. Then, the program mode switch process routine is completed, so that the processing returns back to the main routine shown in FIG. 9.

Figure 15:
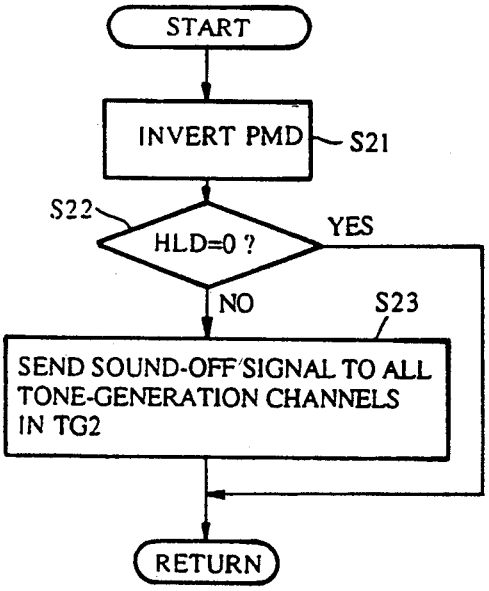

(ii) Pad mode switch 14*b*:

When the pad mode switch 14*b* is pushed, the pad mode switch process routine as shown in FIG. 15 is activated. In first step S21, the CPU 18 inverts the value of the pad mode flag PGM set in the RAM 20. In next step S22, it is judged whether or not the hold mode flag HLD is at "1". If the judgement of step S22 is "YES", the processing returns back to the main routine. On the other hand, if the judgment of step S22 is "NO", the processing proceeds to step S23 wherein the sound-off signal is supplied to the tone generator TG2 so that generation of the musical tone is terminated. Then, the processing returns back to the main routine. Herein, in the case where the hold mode flag HLD is set at "0", the effected tone is attenuated in accordance with the predetermined attenuating curve (which will be described later) as similar to the percussion instrument tone described before. Therefore, it is not necessary to send the sound-off signal to the tone generator TG2 when HLD is at "0". In this routine shown in FIG. 15, the process of step S23 is executed only in the case where the hold mode flag HLD is at "1".

Figure 16:
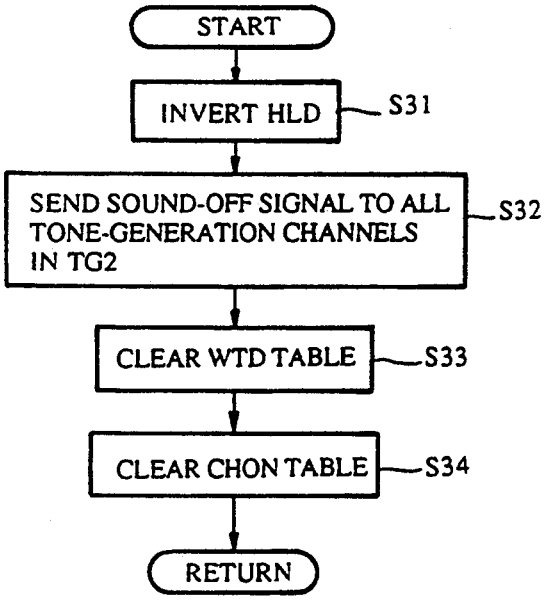

(iii) Hold mode switch 14*c*:

When the hold mode switch 14*c* is pushed, the hold mode switch process routine as shown in FIG. 16 is activated. In first step S31, the hold mode flag HLD is inverted. In step S32, the sound-off signals are supplied to all channels of the tone generator TG2 so that generation of the musical tone is terminated. In step S33, the wait time table WTD(j) is cleared so that "1" is written in WTD(j). In step S34, the channel-on flag CHON(j) is cleared with respect to all channels of the tone generator TG2 so that "0" is written in CHON(j). Thereafter, the processing returns back the main routine.

As described above, the flags PGM, PMD and HLD are changed over in response to the operation of the switch section 14, by which the operational mode of the present electronic musical instrument is changed over.

Next, description will be given with respect to the operation of the program mode and normal performance mode, wherein the percussion instrument tone and effected tone are assigned to desirable pads within the pads PA1–PAm.

(b) Program Mode

As described before, when the performer pushes the program mode switch 14*a* to thereby set the program mode flag PGM at "1", the operational mode of the CPU 18 is changed over to the program mode.

Figure 17:
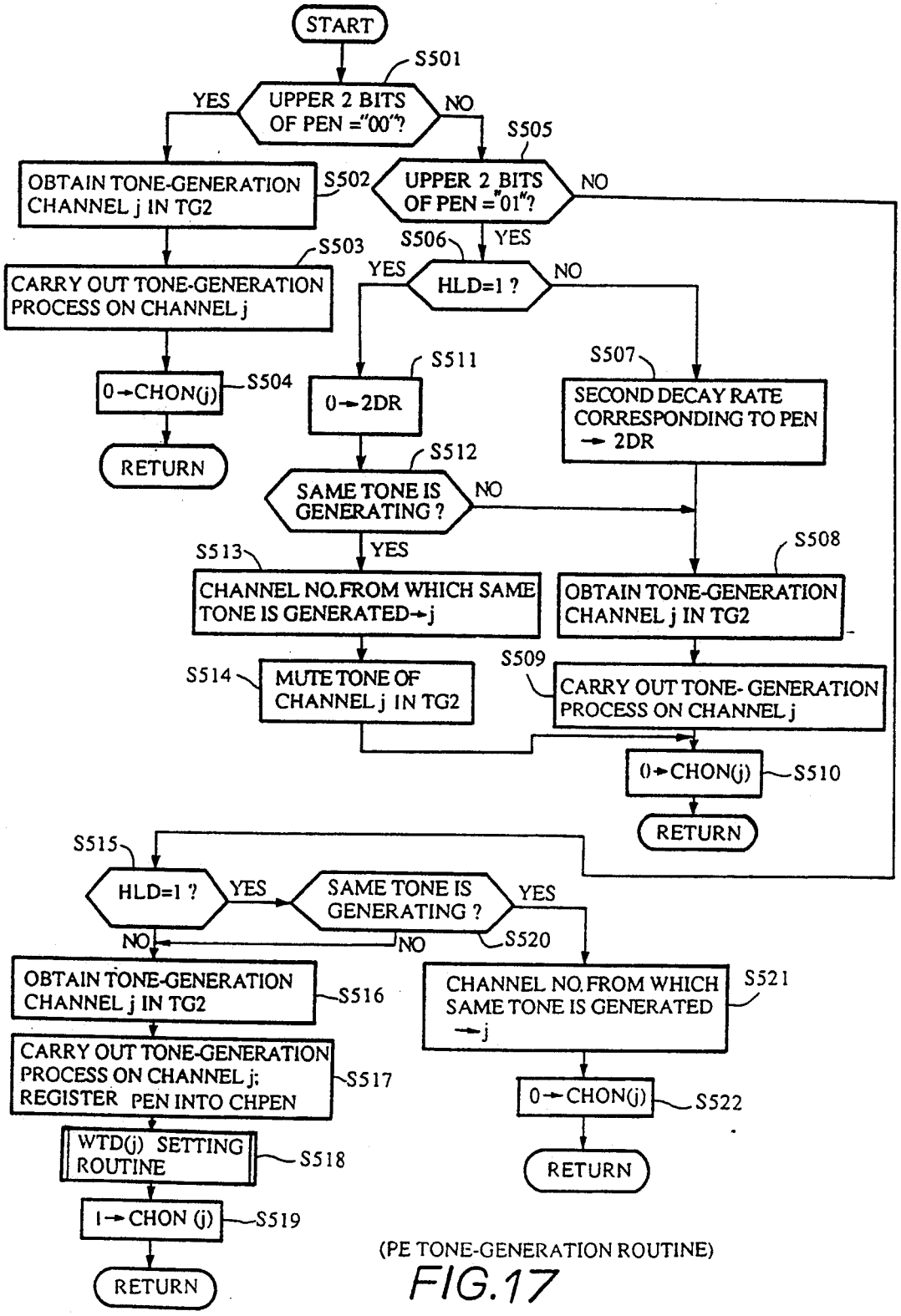

In the program mode, when the performer depresses the key of the keyboard 11, the key-on process routine as shown in FIG. 10 is activated in step S2 of the main routine shown in FIG. 9. At first, the key code is generated from the keyboard 11 with respect to the key on which the key-on event has occurred, and then the CPU 18 stores such key code in a key code buffer KCD in step S101. In next step S102, a key-on flag KON is set at "1". In step S103, it is judged whether or not the program mode flag PGM is at "1". In this case, the judgement of step S103 turns to "YES" so that the processing proceeds to step S104. In step S104, the CPU 18 extract data KPC(KCD) corresponding to the key code KCD from the PEN information stored in the tone source kind table KPC(k) (where k ranges from "1" to "nk"). Then the extracted data KPC(KCD) is stored in the tone source designating register PEN set within the RAM 20. In step S105, a PE tone-generation routine as shown in FIG. 17 is activated. As a result, the tone generator TG2 generates the percussion instrument tone or effected tone corresponding to the PEN information stored in the register PEN. Incidentally, detailed description of the above-mentioned PE tone-generation routine will be given later in "(c) Normal Performance Mode".

Next, the processing proceeds to step S106 wherein it is judged whether or not both of the pad-on flag PON(i) (where i ranges from "1" to "m") and pad mode flag PMD are at "1". If the judgement of step S106 is "NO", the processing returns back to the main routine. In contrast, in the case where the pad mode flag PMD is set at "1" and the pad-on event of the pad PAi is detected so that the pad-on flag PON(i) is at "1", the judgement of step S106 is "YES" so that the processing proceeds to step S107. Herein, the CPU 18 detects the pad number i at which the pad mode flag PON(i) is at "1". Then, the PEN information is written in the pad assigning table PAST(i) corresponding to the detected pad number i. After executing the process of step S107, the processing returns back to the main routine.

Next, in the program mode, when the key-off event is detected in the keyboard 11, the key-off process routine as shown in FIG. 11 is activated in step S2 of the main routine shown in FIG. 9. In first step S201, a buffer BUF inputs the key code corresponding to the key on which the key-off event has occurred. In next step S202, it is judged whether or not the program mode flag PGM is at "1". In this case, the judgement of step S202 turns to "YES", so that the processing proceeds to step S203 wherein it is judged whether or not the key-on event has occurred on any one of other keys. If the judgement of step S203 is "NO", the processing proceeds to step S204 wherein the key-on flag KON is cleared. Then, the processing returns back to the main routine. On the other hand, if the judgement of step S203 is "YES", the processing proceeds to step S205 wherein the CPU 18 searches the key which was last depressed on until now and then obtains a key code KCD indicative of the searched key. In this case, the process of step S204 is omitted so that the key-on flag KON is not cleared. In other words, as long as any key is depressed on, the key-on flag KON is maintained at "1". In addition, the key code corresponding to the key which is last depressed on within the currently depressed keys is held as KCD. Such key code will be assigned to the pad due to the pad-on event, which will be described later. After completing the key-off process routine, the processing returns back to the main routine.

Meanwhile, when any one of the pads PA1–PAm is operated on in the program mode, the pad-on process routine as shown in FIG. 12 is activated in step S3 of the main routine shown in FIG. 9 In first step S301, the CPU 18 searches the number i of the pad PAi which is on. In next step S302, "1" is set in the pad-on flag PON(i) corresponding to the searched pad number i. In step S303, it is judged whether or not the program mode flag PGM is at "1". In this case, the judgement of step S303 turns to "YES", so that the processing proceeds to step S304 wherein it is judged whether or not the key-on flag KON is set at "1". If the judgement of step S304 is "YES" indicating that the key-on event is detected at this moment, the processing proceeds to step S305. In step S305, by referring to the key code KCD, the CPU 18 extracts the data KPC(KCD) corresponding to the key code KCD from the PEN information stored in the tone source kind table KPC(k) (where k ranges from "1" to "nk") set in the ROM 19. Then, the extracted data KPC(KCD) is stored in the register PEN. Next, the processing proceeds to step S306 wherein the PEN information stored in the register PEN is written into the pad assigning table PAST(i) corresponding to the pad whose on-event is detected. Thereafter, the processing returns back to the main routine.

On the other hand, when the key-on flag KON is at "0", the depressing pressure is not detected with respect to the key to be assigned, so that the judgement of step S303 turns to "NO". Thus, the processing directly branches to step S307, and consequently the processes of steps S307 will be executed. As a result, the tone generator TG2 generates the percussion instrument tone or effected tone. Thereafter, the processing returns back to the main routine. Herein, description of the processes of steps S307 will be described later in the "Normal Performance Mode", hence, such description is omitted in the "Program Mode".

Next, when the pad-off event is detected in the program mode, the pad-off process routine as shown in FIG. 13 is activated. In this routine, the CPU 18 detects the pad number i whose pad is off in step S401; and then the pad-on flag PON(i) is cleared in step S402. Therefore, during the period between the pad-on timing (when the foregoing pad-on process routine is activated) and the pad-off timing (when the foregoing pad-off process routine is activated), the pad-on flag PON(i) corresponding to the operated pad PAi is maintained at "1".

In the program mode as described heretofore, when the key-on event is detected on the keyboard 11 and the pad-on event is also detected on any one of the pads PA1–PAm, the PEN information corresponding to the depressed key (which is read from the table KPC) is assigned to the pad assigning table PAST(i) corresponding to the operated pad. Herein, the process of writing the PEN information into the pad assigning table PAST(i) is included in both the key-on process routine and pad-on process routine. Therefore, even if one of these two processes is activated first as compared to the other process, the process of assigning the PEN information to the pad assigning table PAST(i) can be normally carried out.

(c) Normal Performance Mode

When the performer pushes the program mode switch 14a to thereby set the program mode flag PGM at "0", the operational mode of the second embodiment is set to the normal performance mode.

Next, description will be given with respect to the operation of the CPU 18 in the following two cases, i.e., (i) first case where the keyboard operation is made, and (ii) second case where the pad operation is made.

(i) First case where the keyboard operation is made:

When the keyboard 11 is operated so that the key-on event is detected, the key-on process routine shown in FIG. 10 is activated in step S2 of the main routine. In this case, the CPU 18 inputs the key code KCD corresponding to the key on which the key-on event has occurred in step S101. In next step S102, "1" is set to the key-on flag KON. Then, the judgement of step S103 turns to "NO" so that the processing branches to step S108 wherein the CPU 18 scans the channels of the tone generator TG1 to thereby search the number j of the idling channel (or space channel) which does not generate the musical tone. Next, the processing proceeds to step S109 wherein the key code KCD and key-on signal KON are sent to No.j channel of the tone generator TG1. As a result, the tone generator TG1 generates the melody tone corresponding to the key code KCD. Thereafter, the processing returns back to the main routine.

Meanwhile, when the key-off event is detected in the keyboard 11, the key-off process routine shown in FIG. 11 is activated in step S2 of the main routine. First, the buffer BUF inputs the key code of the key on which the key-off event has occurred in step S201. Then, the judgement of step S202 turns to "NO" so that the processing branches to step S206 wherein the CPU searches the channel which generates the musical tone corresponding to the key code stored in the buffer BUF within the channels which currently generate the musical tones in the tone generator TG1. In step S207, it is judged whether or not the above-mentioned channel is found by the CPU 18. If the judgement of step S207 is "NO", the processing returns back to the main routine. On the other hand, if the judgement of step S207 is "YES" indicating that the CPU 18 finds the channel which generates the musical tone corresponding to the key code in BUF, the key-off signal is sent to such channel in step S208. Thus, the tone generator TG1 stops generating the melody tone corresponding to the key on which the key-off event has occurred.

(ii) Second case where the pad operation is made:

When any one of the pads PA1–PAm is operated so that its pad-on event is detected, the pad-on process routine shown in FIG. 12 is activated in step S3 of the main routine. In step S301 shown in FIG. 12, the CPU 18 searches the pad number i of the pad on which the pad-on event has occurred. In step S302, the corresponding pad-on flag PON(i) is set. Incidentally, during the period between the first time when the pad PAi is off and the second time when the pad-off process routine (shown in FIG. 13) is activated, the pad-on flag PON(i) is maintained at "1". Then, the judgement of step S303 turns to "NO" so that the processing branches to step S307 wherein it is judged whether or not the pad mode flag PMD is at "1". If the judgement of step S307 is "YES", the processing proceeds to step S308. On the other hand, if the judgement of step S307 is "NO", the processing branches to step S309. In step S308, the data in the pad assigning table PAST(i) corresponding to the number i is written into the register PEN. On the other hand, in step S309, the data in the pad tone source table PET(i) corresponding to the number i is written into the register PEN. After executing the process of step S308 or S309, the processing proceeds to step S310 wherein the PE tone-generation routine shown in FIG. 17 is activated.

Next, description will be given with respect to the PE tone-generation routine by referring to FIG. 17.

In first step S501, it is judged whether or not the upper two bits of the PEN information equal to "00". When the judgement of step S501 is "YES" indicating that the musical tone to be generated is the percussion instrument tone, the processing proceeds to step S502 wherein the CPU 18 searches the idling channel number j in the tone generator TG2. Then, the channel-on flag CHON(j) corresponding to the searched idling channel number j is set. Next, the processing proceeds to step S503 wherein the sound-on signal and tone source data corresponding to the PEN information are sent to No.j channel in the tone generator TG2. As a result, the sound system 17 will generate the percussion instrument tone corresponding to the PEN information. In next step S504, the channel-on flag CHON(j) is cleared. Then, the processing of the PE tone-generation routine is ended.

Meanwhile, when the upper two bits of the PEN information equal to "01" indicating that the musical tone to be generated is the effected tone having the continuity, the judgement of step S501 turns to "NO" so that the processing directly branches to step S505, whose judgement turns to "YES". Thus, the processing proceeds to step S506 wherein it is judged whether or not the hold mode flag HLD is at "1".

Figure 18:
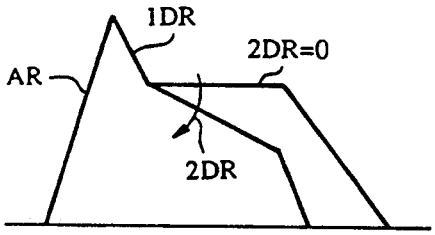
FIG. 18 shows an envelope waveform used in the second embodiment.

If the judgement of step S506 is "NO", the processing proceeds to step S507 wherein the CPU 18 computes a second decay rate of the envelope corresponding to the PEN information. Then, the computed second decay rate is inputted into a buffer 2DR. In next step S508, the CPU 18 searches the idling channel number j of the tone generator TG2, and then the corresponding channel-on flag CHON(j) is set. In step S509, the sound-on signal, information stored in the buffer 2DR and tone source data corresponding to the PEN information are sent to No.j channel in the tone generator TG2. As a result, the sound system 17 generates the effected tone corresponding to the PEN information. In this case, as shown in FIG. 18, the envelope level of the effected tone to be generated rises up with the predetermined attack rate AR, and then attenuates with the second decay rate corresponding to the PEN information stored in the buffer 2DR. As similar to the percussion instrument tone, the effected tone to be generated in the tone generator TG2 has the continuity. Next, the processing proceeds to step S510 wherein the channel-on flag CHON(j) is cleared so that "0" is set to CHON(J). This completes the execution of the PE tone-generation routine.

On the other hand, when the hold mode flag HLD is at "1", the judgement of step S506 turns to "YES" so that the processing directly branches to step S511 wherein "0" is stored in the buffer 2DR. In next step S512, it is judged whether or not the data identical to the PEN information is included in the channel table CHPEN(j). If the judgement of step S512 is "YES", the processing proceeds to step S513 wherein the CPU 18 inputs the corresponding channel number j. In step S514, the sound-off signal is sent to No.j channel in the tone generator TG2 so that generation of the corresponding musical tone is terminated. Then, the processing proceeds to step S510 wherein the channel-on flag CHON(j) is cleared. In short, under the above-mentioned processes, the effected tone having the continuity which is generated at first pad-on event is muted at second pad-on event. Herein, the process of generating the effected tone having the continuity at first pad-on event will be described later in detail. After completing the process of step S510, the processing is returned to the main routine.

On the other hand, when the judgement of step S512 is "NO" indicating that the channel table CHPEN(j) does not include the data identical to the PEN information, the processes of foregoing steps S508-S510 are executed so that the effected tone is generated. In this case, however, "0" is set in the buffer 2DR. Therefore, the envelope of the effected tone which is generated from the tone generator TG2 has the continuity at second decay portion as shown in FIG. 13. In short, under the above-mentioned processes, the effected tone having the continuity is generated at first pad-on event.

Next, in the case where the upper two bits of the PEN information equal to "10" or "11", the processing directly branches to step S515 via steps S501; S505. In step S515, it is judged whether or not the hold mode flag HLD is at "1". If the judgement of step S515 is "NO", the processing proceeds to step S516 wherein the CPU 18 searches the idling channel number j of the tone generator TG2. In next step S517, the sound-on signal and tone source data corresponding to the PEN information are sent to No.j channel of the tone generator TG2. As a result, the sound system 17 generates the percussion instrument tone corresponding to the PEN information. Further, the PEN information is stored in the channel table CHPEN(j) corresponding to the channel number j. Then, the processing proceeds to step S518 wherein a WTD(j) setting routine as shown in FIG. 19 is activated.

Figure 19:
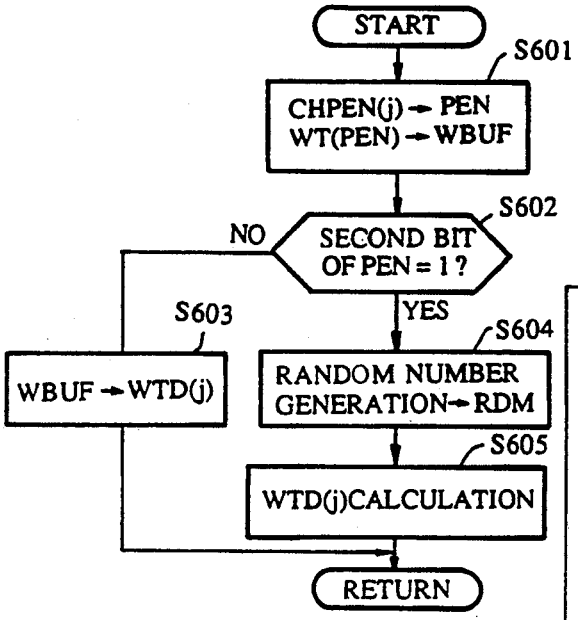

In first step S601 shown in FIG. 19, the CPU 18 reads the PEN information from the channel table CHPEN(j). In addition, the CPU 18 reads out wait time information WT(PEN) corresponding to the read PEN information from the wait time table WT(n) set in the ROM 19. Then, the read wait time information WT(PEN) is stored in a buffer WBUF. In next step S602, it is judged whether or not second bit of the PEN information equals to "1". If the judgement of step S602 is "NO" indicating that the upper two bits of the PEN information equal to "10", the processing proceeds to step S603 wherein the wait time information stored in the buffer WBUF is written into the wait time table WTD(j) corresponding to the channel number j. Thereafter, the processing returns back to its source processing, i.e., the PE tone-generation routine in this case. On the other hand, when the judgement of step S602 is "YES" indicating that the upper two bits of the PEN information equal to "11", the processing branches to step S604 wherein a random number is generated and then stored in a buffer RDM. Then, the processing proceeds to step S605 wherein the wait time to be stored in the wait time table WTD(j) is calculated by the following formula (1) based on the random number RDM, the wait time information WT(PEN) and scaling parameter WTSP(PEN) corresponding to the PEN information set in the ROM 19.

$$WTD(j) = WT(PEN) + RDM * WTSP(PEN) \quad (1)$$

Thereafter, the processing returns to its source processing (i.e., PE tone-generation routine shown in FIG. 17).

More specifically, the processing proceeds from step S518 to step S519 wherein the channel-on flag CHON(j) is set so that "1" is set to CHON(j). Thereafter, the processing returns back to the pad-on process routine.

Meanwhile, if the judgement of step S515 of the PE tone-generation routine is "YES" indicating that the hold mode flag HLD is at "1", the processing branches to step S520 wherein it is judged whether or not the data identical to the PEN information is included in the channel table CHPEN(j). If the judgement of step S520 is "NO", the processes of foregoing steps S516–S519 are executed, and then the processing returns back to the pad-on process routine. On the other hand, if the judgement of step S520 is "YES", the channel-on flag CHON(j) corresponding to the channel number j is cleared so that "0" is set to CHON(j) in steps S521, S522.

Figure 20:
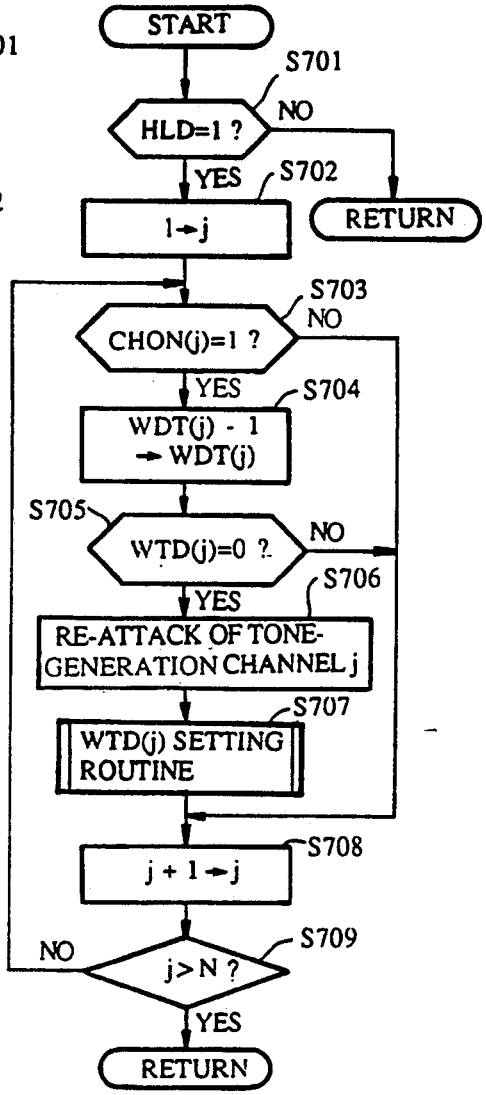

In the present electronic musical instrument according to the second embodiment, the timer 21 sends the interrupt signal to the CPU 18 by every predetermined time interval. Due to the interrupt signal, the CPU 18 breaks its current execution to thereby activate a timer interrupt routine as shown in FIG. 20. In first step S701, it is judged whether or not the hold mode flag HLD is at "1". If the judgement of step S701 is "NO", the processing returns to its source processing (whose execution is interrupted by the interrupt signal). On the other hand, if the judgement of step S701 is "YES", the processing proceeds to step S702 wherein the variable j is set equal to "1". In step S703, it is judged whether or not the channel-on flag CHON(j) is at "1". Herein, under the state of CHON(j)=1, the effected tone which repeats the attack portion is assigned to No.j channel. If the judgement of step S703 is "NO", the processing directly branches to step S708. On the other hand, if the judgement of step S703 is "YES", the processing proceeds to step S704. In step S704, the value of the wait time table WTD(j) corresponding to No.j channel in the tone generator TG2 is decremented. In step S705, it is judged whether or not the value of the wait time table WTD(j) reaches equal to "0". If the judgement of step S705 is "NO", the processing branches to step S708. On the other hand, if the judgement of step S705 is "YES", the processing proceeds to step S706. In step S706, the sound-on signal is sent to No.j channel in the tone generator TG2. As a result, the effected tone which is currently generated from No.j channel is subject to the attack state again. Next, the processing proceeds to step S707 wherein the foregoing WTD(j) setting routine is activated, by which the wait time between current attack timing and next attack timing is computed with respect to No.j channel. Then, the value of the wait time table WTD(j) is renewed by the newly computed wait time. Herein, the wait time table WTD(j) stores the wait time value corresponding to the PEN information only while the second bit of the data stored in the channel table CHPEN(j) (i.e., the PEN information corresponding to the channel number j) is at "0". On the other hand, when the second bit of the data stored in the channel table CHPEN(j) is at "1", the wait time table WTD(j) stores the value corresponding to the random number which is currently generated. Thereafter, the processing proceeds to step S708 wherein the variable j is incremented. In step S709, it is judged whether or not the incremented variable j exceeds the maximum value n which is the maximum channel number as well. Then, the processing returns to step S703 when the judgement of step S709 is "NO", while the processing returns to its source processing which is interrupted by the present timer interrupt routine.

As described heretofore, the processes of steps S516–S519 of the PE tone-generation routine are executed in the case where the performer operates on the pad (indicated by pad A, for example) to which the PEN information whose upper two bits equal to "10" or "11" is assigned when the hold mode flag HLD is at "1"; and such PEN information corresponds to the first pad-on event. Thus, the PEN information is registered in the assigned tone-generation channel (i.e., No.j channel), and the channel-on flag CHON(j) is set at "1". After the channel-on flag CHON(j) is set, No.j channel repeatedly forms the attack portion every time the timer interrupt process routine is activated so that the value of the wait time table WTD(j) equals to "0".

In the above-mentioned state, when the pad A described before is operated on again, the judgement of step S520 of the PE tone-generation routine turns to "YES" so that the processing proceeds to step S521. The CPU 18 searches the channel number j corresponding to the channel which currently generates the effected tone in response to the PEN information corresponding to the operated pad A in step S521, and then the channel-on flag CHON(j) is cleared in step S522. Thereafter, the processing return back to the pad-on process routine. Thereafter, generation of the effected tone corresponding to the pad A is terminated in No.j channel. As described heretofore, in the case where the upper two bits of the PEN information corresponding to the operated pad equal to "10" or "11" and the hold mode flag HLD is at "1", the tone generator generates the effected tone which repeatedly forms the attack portion at first pad-on timing. However, at second pad-on timing when the pad is operated on again, generation of such effected tone is terminated.

Lastly, this invention may be practiced or embodied in still other ways without departing from the spirit or essential character thereof. Therefore, the preferred embodiments described herein are illustrative and not restrictive, the scope of the invention being indicated by the appended claims are intended to be embraced therein.

What is claimed is:

1. An electronic musical instrument comprising:

(a) manually operable means adapted to be manually operated by a performer in order to carry out a musical performance;

(b) detecting means for detecting an operation effected on said manually operable means;

(c) input means for inputting a hold command from the performer;

(d) tempo clock generating means for generating a tempo clock having a frequency corresponding to a predetermined performance speed;

(e) count means for counting said tempo clock;

(f) storing means for storing musical tone information corresponding to the operation of said manually operable means and also holding a count value of said count means corresponding to a time when said manually operable means are operated during a period when said input means inputs said hold command;

(g) timing generating means for generating timing signals for generating an effected tone, said timing signals being generated every time the count value of said count means coincides with the value stored in said storing means; and (h) musical tone generating means for generation a musical tone in response to the operation of said manually operable means, said musical tone generating means repeatedly generating musical tones corresponding to said musical tone information and based on the timing signals;

wherein said manually operable means includes a plurality of manually operable members which are classified into a first group and a second group, said first and second group of manually operable members respectively corresponding to first and second musical tones, operation of all of said manually operable members being effective during said period when said input means inputs said hold command, said musical tone generating means starting to generate said first or second musical tone when said manually operable members are operated on, said musical tone generating means stopping generation of said first musical tone when said manually operable member of said first group is operated off, while said musical tone generating means continues to generate said second musical tone even if said manually operable member of said second group is operated off, said musical tone generating means repeatedly generating said second musical tone every time the count value of said count means coincides with that held in said storing means in the case where said storing means stores said musical tone information corresponding to said first group of manually operable members.

2. An electronic musical instrument according to claim 1 wherein said manually operable means includes a keyboard or a plurality of pads to be beaten by the performer.

3. An electronic musical instrument according to claim 1, wherein said manually operable members are pads adapted to be beaten by the performer.

4. An electronic musical instrument according to claim 1 wherein said musical tone generating means can generate an attenuating tone whose tone volume is attenuated after an off-event of said manually operable means or a continuing tone whose tone volume is continued for a while after an off-event of said manually operable means, said attenuating tone being selectively changed over to said continuing tone when said hold command is inputted.

5. An electronic musical instrument according to claim 1 wherein said musical tone generating means generates said musical tone at once when said hold command is not inputted, while said musical tone generating means can repeatedly generate said musical tone when said hold command is inputted.

6. An electronic musical instrument according to claim 1 wherein said storing means holds said musical tone information in response to the tone color when said hold command is inputted.

7. An electronic musical instrument comprising:

(a) random number generating means for generating random numbers;

(b) tone designating means for designating musical tones which are repeatedly generated;

(c) tone generation timing designating means for designating the time between the first tone generation timing and the second tone generation timing of the tones according to said random number; and (d) tone source means for generating musical tones under designation of said tone designating means.

* * * * *